US010004323B1

(12) United States Patent
Sacca et al.

(10) Patent No.: US 10,004,323 B1
(45) Date of Patent: Jun. 26, 2018

(54) HAIR BRUSH WITH HAIR PRODUCT-DISPENSING HANDLE

(71) Applicants: Peter Sacca, Tappan, NY (US); Penny Sacca, Tappan, NY (US)

(72) Inventors: Peter Sacca, Tappan, NY (US); Penny Sacca, Tappan, NY (US)

( * ) Notice: Subject to any disclaimer, the term of this patent is extended or adjusted under 35 U.S.C. 154(b) by 0 days. days.

(21) Appl. No.: 15/231,942

(22) Filed: Aug. 9, 2016

(51) Int. Cl.

| | |
|---|---|
| ***A46B 11/00*** | (2006.01) |
| ***A45D 19/02*** | (2006.01) |
| ***A46B 9/02*** | (2006.01) |
| ***A45D 24/22*** | (2006.01) |

(52) U.S. Cl.
CPC ..... *A46B 11/0072* (2013.01); *A45D 19/02* (2013.01); *A45D 24/22* (2013.01); *A46B 9/023* (2013.01)

(58) Field of Classification Search
CPC ..... A45D 24/22; A45D 24/28; A45D 19/02; B65D 43/16; A46B 9/023; A46B 11/072
See application file for complete search history.

(56) References Cited

U.S. PATENT DOCUMENTS

| | | | | |
|---|---|---|---|---|
| D271,179 | S | 11/1983 | Smith | |
| D279,648 | S | 7/1985 | Fini | |
| 4,557,619 | A | 12/1985 | DeVincentis | |
| 4,716,915 | A * | 1/1988 | Burns | A45D 34/02 132/148 |
| 5,213,430 | A | 5/1993 | Pandola | |
| 5,746,531 | A | 5/1998 | Izhak | |
| 7,309,182 | B2 | 12/2007 | McKay | |

FOREIGN PATENT DOCUMENTS

| | | | |
|---|---|---|---|
| EP | 1639911 | A2 | 3/2006 |

* cited by examiner

*Primary Examiner* — Jennifer C Chiang
*Assistant Examiner* — Bradley Oliver

(57) ABSTRACT

The hair brush with hair product-dispensing handle is adapted for use in dispensing liquids and gels. The hair brush with hair product-dispensing handle is adapted for use in the personal grooming of hair. The hair brush with hair product-dispensing handle further comprises a chamber within which a container with a liquid or gel is stored. The stored container is readily accessible during grooming activities involving the hairbrush. The hair brush with hair product-dispensing handle is hinged such that the hair brush with hair product-dispensing handle can be folded in such a manner that the profile of the hair brush with hair product-dispensing handle is reduced during transport. The hair brush with hair product-dispensing handle comprises a handle, a brush head, and a plurality of teeth.

4 Claims, 5 Drawing Sheets

HAIR BRUSH WITH HAIR PRODUCT-DISPENSING HANDLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of brushware, more specifically, a brush with a means for applying a liquid or gel.

SUMMARY OF INVENTION

The hair brush with hair product-dispensing handle is adapted for use in dispensing liquids or gels. The hair brush with hair product-dispensing handle is adapted for use in the personal grooming of hair. The hair brush with hair product-dispensing handle further comprises a chamber within which a container with a liquid or gel is stored. The stored container is readily accessible during grooming activities involving the hairbrush. The hair brush with hair product-dispensing handle is hinged such that the hair brush with hair product-dispensing handle can be folded in such a manner that the profile of the hair brush with hair product-dispensing handle is reduced during transport.

These together with additional objects, features and advantages of the hair brush with hair product-dispensing handle will be readily apparent to those of ordinary skill in the art upon reading the following detailed description of the presently preferred, but nonetheless illustrative, embodiments when taken in conjunction with the accompanying drawings.

In this respect, before explaining the current embodiments of the hair brush with hair product-dispensing handle in detail, it is to be understood that the hair brush with hair product-dispensing handle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hair brush with hair product-dispensing handle.

It is therefore important that the claims be regarded as including such equivalent construction insofar as they do not depart from the spirit and scope of the hair brush with hair product-dispensing handle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
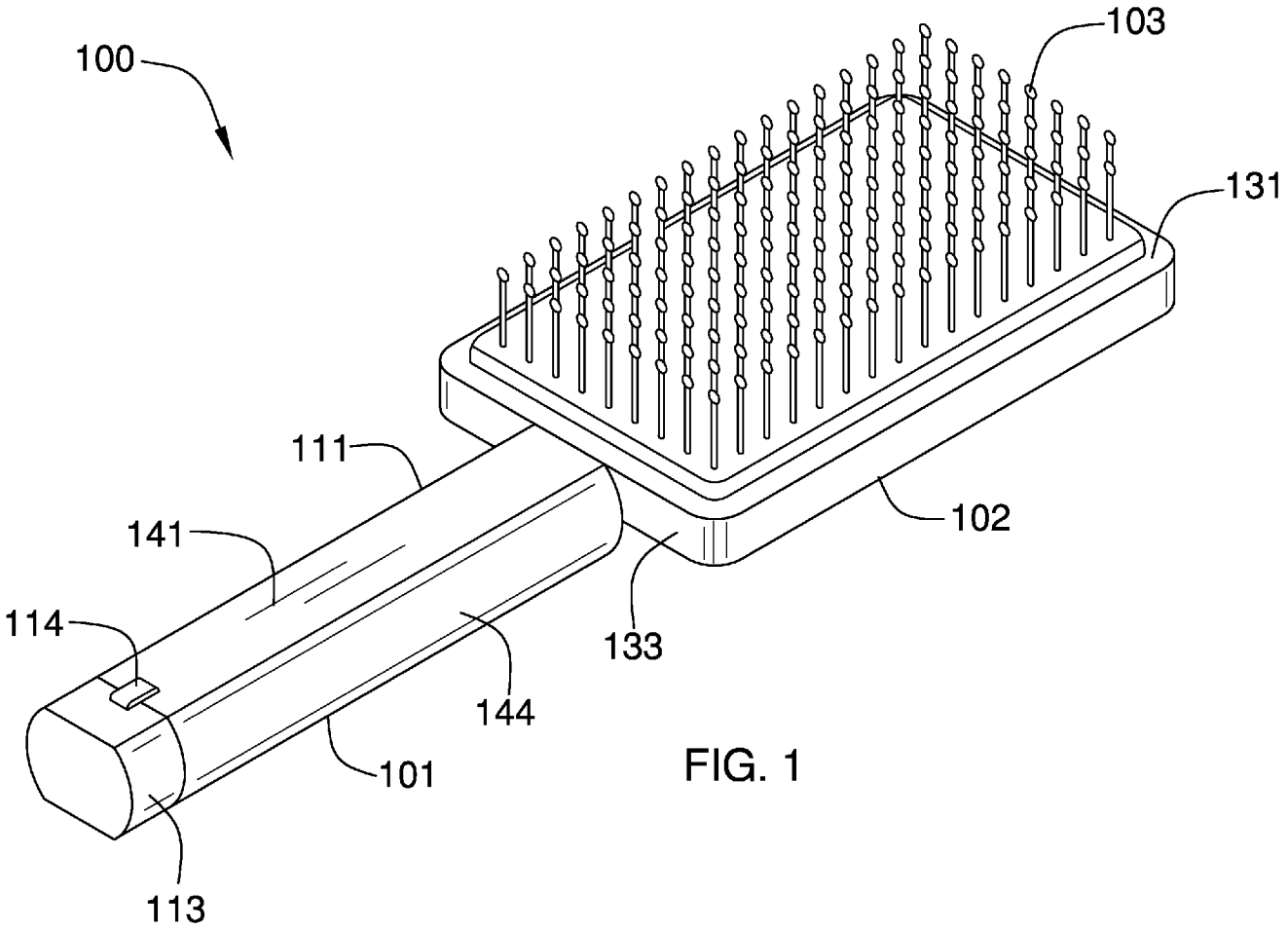
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The hair brush with hair product-dispensing handle 100 (hereinafter invention) comprises a handle 101, a brush head 102, and a plurality of teeth 103. The invention 100 is adapted for use in dispensing a liquid 151 or a gel (hereinafter the term liquid is assumed to include gels). The invention 100 is adapted for use in the personal grooming of hair. The invention further comprises a chamber 112 within which a container 152 with the liquid 151 is stored. The stored container 152 is readily accessible during grooming activities involving the hairbrush. The invention 100 is hinged such that the invention 100 can be folded in such a manner that the profile of the invention 100 is reduced during transport. The plurality of teeth 103 and the handle 101 are attached to the brush head 102.

The brush head 102 has a plate structure. The brush head 102 is further defined with a first surface 131, a second surface 132, and a first edge 133. The plurality of teeth 103 are a collection of short stiff rod-like objects that project away from the first surface 131 of the brush head 102. By running hair through the plurality of teeth 103, the plurality of teeth 103 will detangle hair as part of the personal grooming process. The composition of the plurality of teeth 103 are selected from the group consisting of a plurality of rods or a plurality of bristles.

Figure 4:
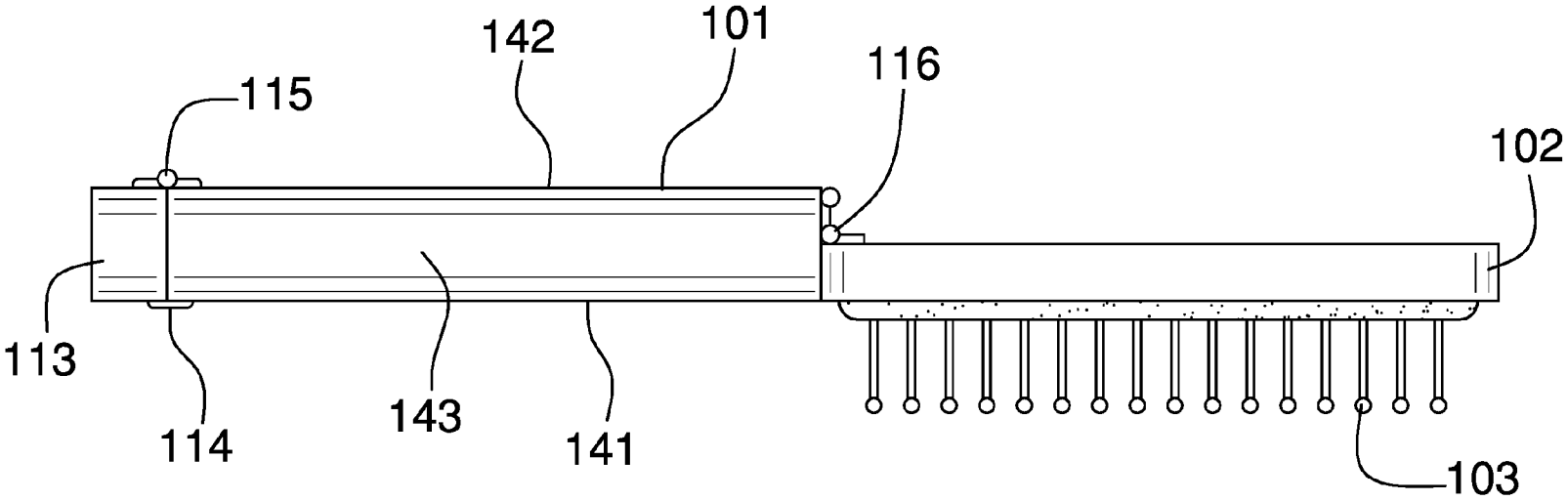
FIG. 4 is a side view of an embodiment of the disclosure.
Figure 5:
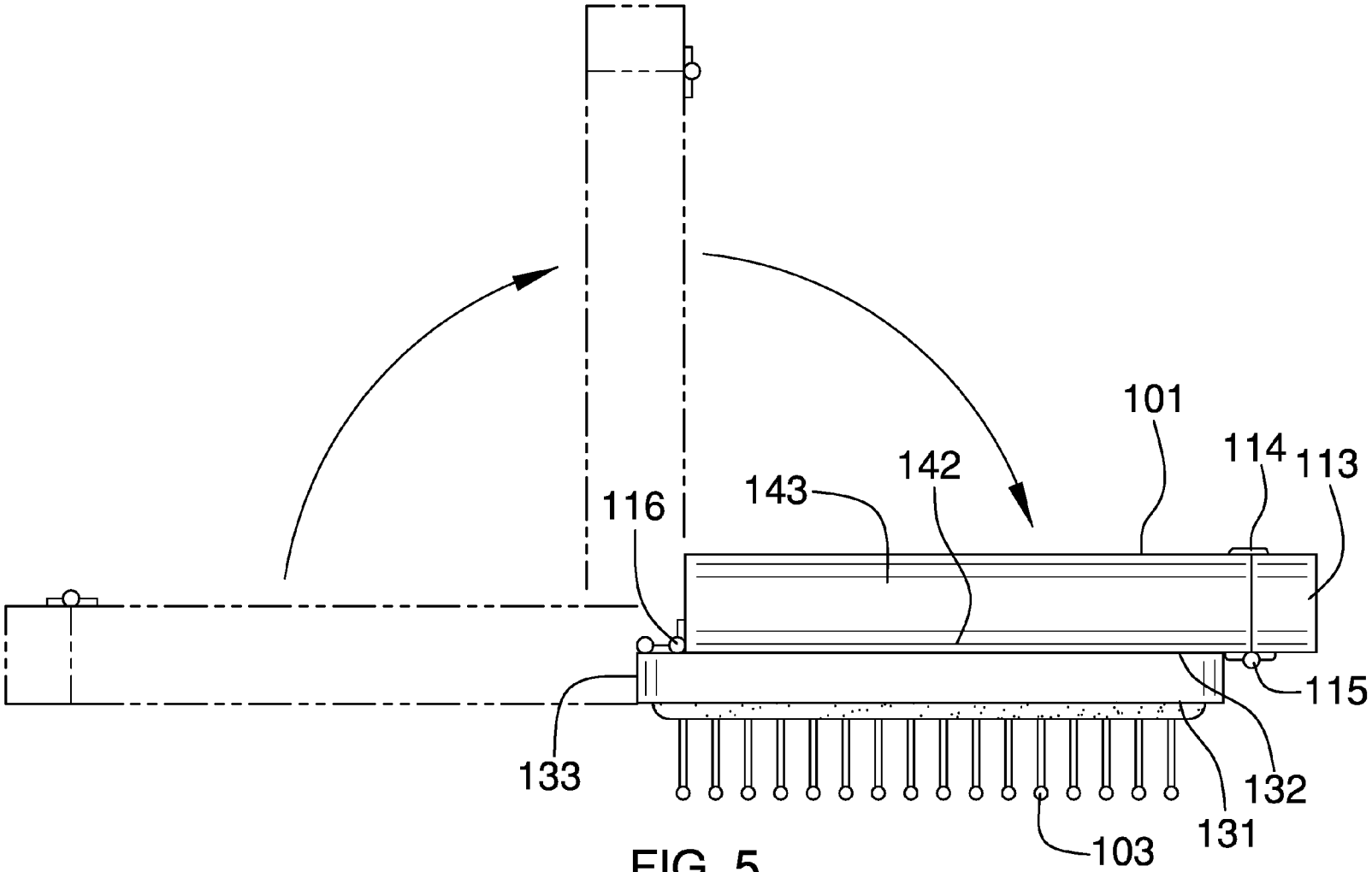
FIG. 5 is a side view of an embodiment of the disclosure.

In the first potential embodiment of the disclosure, as shown most clearly in FIGS. 1, 4, and 5, the brush head 102 is formed in the shape of a rectangular block and the plurality of teeth 103 comprises a plurality of rods. Each of the plurality of teeth 103 project perpendicularly away from the first surface 131 of the brush head 102.

The handle 101 is a grip that is used to manipulate the invention 100 during grooming activities. The handle 101 further comprises a tubular structure 111, a chamber 112, a cap 113, a latch 114, a first hinge 115, and a second hinge 116. The chamber 112 is formed within the hollow interior of the tubular structure 111. The first hinge 115 attaches the cap 113 to the tubular structure ill. The second hinge 116 attaches the tubular structure 111 to the brush head 102. The latch 114 secures the cap 113 to the tubular structure 111. The chamber 112 is the structure within the handle 101 within which the container 152 with the liquid 151 is stored. The size of the chamber 112 is determined such that the intended size of the container 152 will fit within the chamber 112.

In the first potential embodiment of the disclosure, the tubular structure 111 is a roughly rectangular hollow tube that is further defined with a first flat face 141, a second flat face 142, a first curved face 143, a second curved face 144, a first end 145 and a second end 146. The hollow space within the tubular structure 111 is referred to as the chamber 112. The first end 145 of the tubular structure 111 is a first aperture 117 that is formed in the end of the tube that provides access into the chamber 112. The surface area of the first flat face 141 is identical to the surface area of the second flat face 142. The surface area of the first curved face 143 is identical to the surface area of the second curved face 144. The surface area of the first curved face 143 is greater than the surface area of the first flat face 141. The surface area of the first flat face 141 is greater than the surface area of the second end 146. The surface area of the first flat face 141 is greater than the surface area of the first aperture 117 of the first end 145. The second flat face 142 is the face of the tubular structure 111 that is distal from the first flat face 141. The second curved face 144 is the face of the tubular structure 111 that is distal from the first curved face 143. The second end is the face of the tubular structure 111 that is distal from the first end 145.

The cap 113 is a covering that encloses the first end 145 of the handle 101. As shown most clearly in FIG. 1, the cap 113 is formed with a plurality of flat cap faces 121 and a plurality of curved cap faces 122, and a third end 123 and a fourth end 124 such that when the third end 123 is placed against the first end 145 of the tubular structure 111: 1) the plurality of flat cap faces 121 will align with the first flat face 141 and the second flat face 142; and, 2) the plurality of curved cap faces 122 will align with the first curved face 143 and the second curved face 144. The cap 113 aligns with the tubular structure 111 in such a manner that the cap 113 appears to be an extension of the tubular structure 111. The third end 123 of the cap 113 further comprises a second aperture 125 which has an identical surface area to the first aperture 117. The fourth end 124 of the cap 113 is closed.

Figure 2:
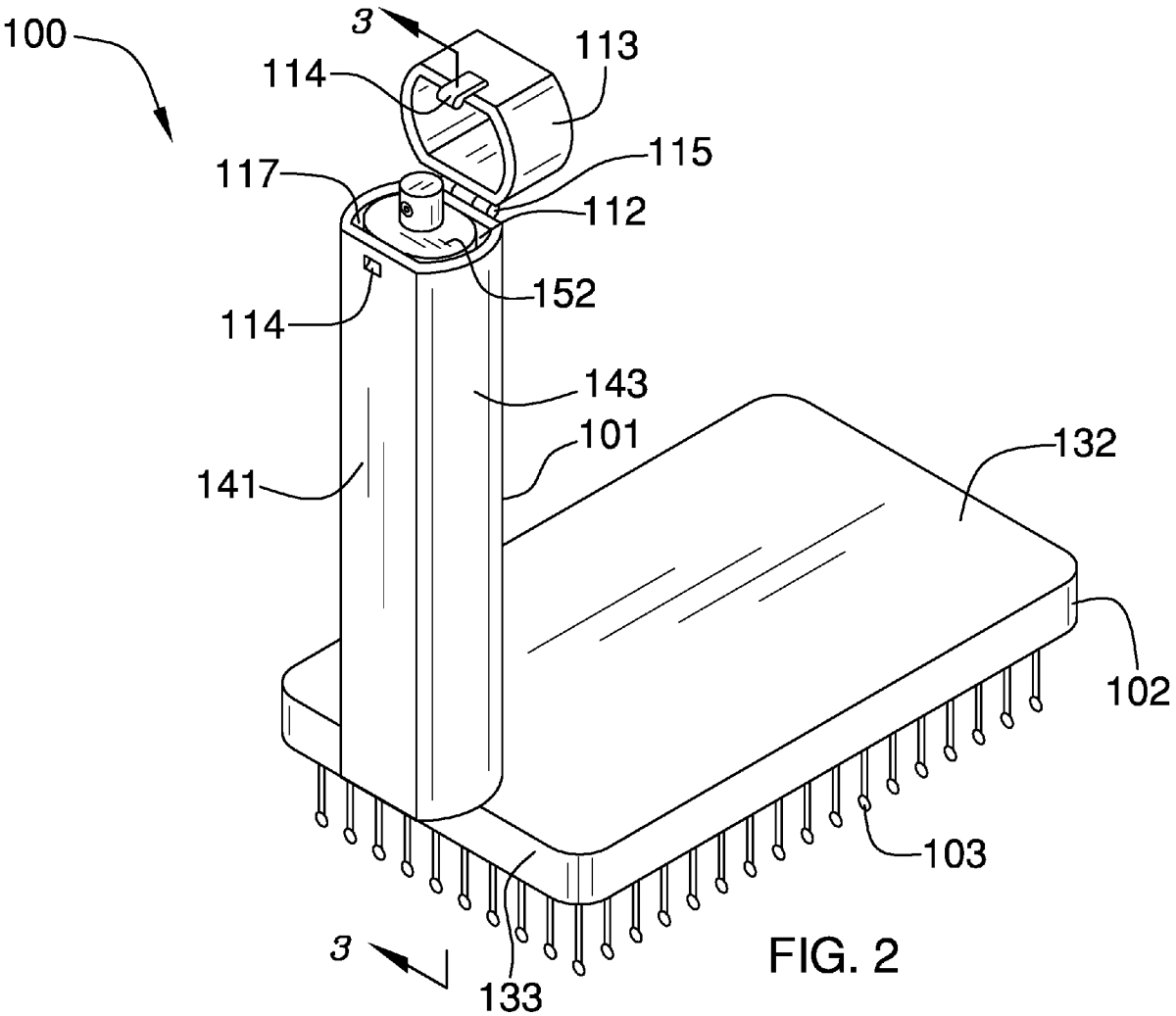
FIG. 2 is a perspective view of an embodiment of the disclosure.
Figure 3:
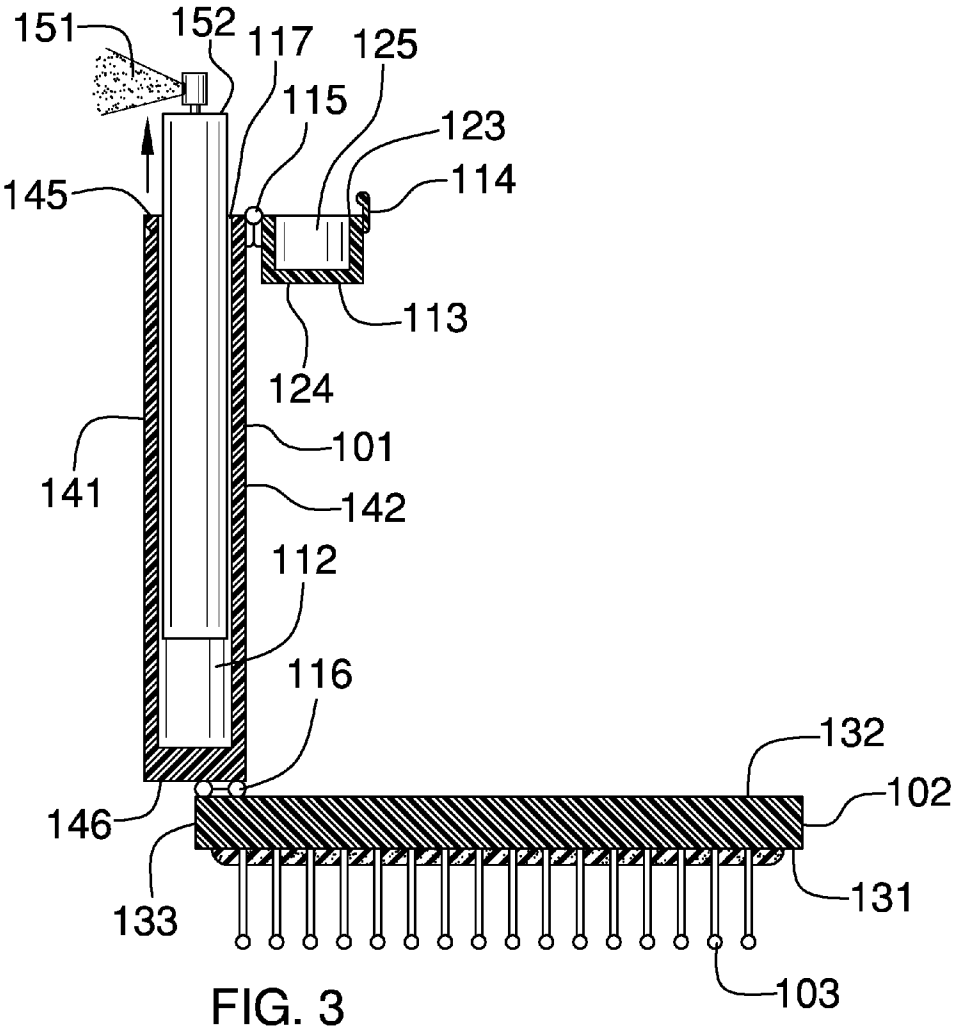
FIG. 3 is a cross-sectional view of an embodiment of the disclosure across 3-3 as shown in FIG. 2.

As shown most clearly in FIGS. 2 and 3, the cap 113 is attached to the tubular structure 111 with the first hinge 115 such that the third end 123 of the cap 113 rests upon the first end 145 of the tubular structure 111 such that the first aperture 117 will align with the second aperture 125 thereby increasing the effective storage capacity of the chamber 112. The first hinge 115 allows the cap 113 to rotate away from the first end 145 using the first hinge 115 as a pivot.

As shown most clearly in FIG. 5, the second hinge 116 attaches the second end 146 of the tubular structure 111 to the first edge 133 of the brush head 102 such that the tubular structure 111 rotate the second end 146 away from the first edge 133 using the second hinge 116 as a pivot. The tubular structure 111 is oriented such that the second flat face 142 of the tubular structure 111 will rotate toward the second surface 132. As shown most clearly in FIG. 5, the second flat face 142 will lay flat against the second surface 132.

The invention 100 is used as a normal hairbrush. Grooming products stored within a container 152 can be stored within the chamber 112 as described above.

In the first potential embodiment of the disclosure, the brush head 102 and the plurality of teeth 103 are formed as a single unit from molded plastic. The tubular structure 111 is formed as a single unit from molded plastic. The cap 113 and the latch 114 are formed as a single unit from molded plastic. The first hinge 115 and the second hinge 116 are commercially available.

The following definitions were used in this disclosure:

Bristle: As used in this disclosure, a bristle is a short coarse hair or hair like object.

Fluid: As used in this disclosure, a fluid refers to a state of matter wherein the matter is capable of flow and takes the shape of a container it is placed within. The term fluid commonly refers to a liquid and in this disclosure, liquid and fluid are synonymous.

Gel: As used in this disclosure a gel refers to a semi-rigid colloidal dispersion of a solid with a liquid or gas.

Hairbrush: As used in this disclosure, a hairbrush is a device that is used for grooming hair that further comprises a handle, a plurality of teeth or bristles, and a brush head.

Hinge: As used in this disclosure, a hinge is a device that permits the turning, rotating, or pivoting of a first object relative to a second object.

Pivot: As used in this disclosure, a pivot is a rod or shaft around which an object rotates or swings.

Plate: As used in this disclosure, a plate is a smooth, flat and rigid object that has at least one dimension that: 1) is of uniform thickness; and 2) that appears thin relative to the other dimensions of the object.

Rod: As used in this disclosure, a rod is a straight structure in which two dimensions of the structure appear thin relative to a third dimension of the straight structure.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A grooming device comprising:

a handle, a brush head, and a plurality of teeth;

wherein the grooming device is adapted for use in dispensing a liquid;

wherein the grooming device is adapted for use in the personal grooming of hair;

wherein the plurality of teeth and the handle are attached to the brush head;

wherein the grooming device further comprises a chamber within which a container with the liquid is stored;

wherein the grooming device is hinged;
wherein the brush head comprises a plate structure;
wherein the brush head is further defined with a first surface, a second surface, and a first edge;
wherein the plurality of teeth comprise collection of short stiff rod-like objects;
wherein the plurality of teeth project away from the first surface of the brush head;
wherein the handle comprises a tubular structure, the chamber, a cap, a latch, a first hinge, and a second hinge;
wherein the chamber is formed within the hollow interior of the tubular structure;
wherein the first hinge attaches the cap to the tubular structure;
wherein the second hinge attaches the tubular structure to the brush head;
wherein the latch secures the cap to the tubular structure;
wherein the size of the chamber is determined such that the size of the container placed within the chamber;
wherein the tubular structure is a hollow tube;
wherein the tubular structure is further defined with a first flat face, a second flat face, a first curved face, a second curved face, a first end and a second end;
wherein the hollow space within the tubular structure is the chamber;
wherein the first end of the tubular structure comprises a first aperture;
wherein the second end of the tubular structure is closed;
wherein the surface area of the first flat face is identical to the surface area of the second flat face;
wherein the surface area of the first curved face is identical to the surface area of the second curved face;
wherein the surface area of the first curved face is greater than the surface area of the first flat face;
wherein the surface area of the first flat face is greater than the surface area of the second end;
wherein the surface area of the first flat face is greater than the surface area of the first aperture of the first end;
wherein the second flat face is the face of the tubular structure that is distal from the first flat face;
wherein the second curved face is the face of the tubular structure that is distal from the first curved face;
wherein the second end is the face of the tubular structure that is distal from the first end;
wherein the cap is a covering that encloses the first end of the handle;
wherein the cap is further defined with a plurality of flat cap faces, a plurality of curved cap faces, a third end and a fourth end;
wherein the third end is placed against the first end such that the plurality of flat cap faces will align with the first flat face and the second flat face;
wherein the third end is placed against the first end such that the plurality of curved cap faces will align with the first curved face and the second curved face;
wherein the cap aligns with the tubular structure such that the cap is an extension of the tubular structure;
wherein the third end of the cap further comprises a second aperture;
wherein the second aperture has an identical surface area to the first aperture;
wherein the fourth end of the cap is closed;
wherein the first hinge attaches the cap to the tubular structure such that the second aperture aligns with the first aperture;
wherein the cap rotates away from the first end;
wherein the second hinge attaches the second end to the first edge;
wherein the second end rotates away from the first edge.

2. The grooming device according to claim 1 wherein the tubular structure is aligned with the brush head such that when the second end rotates away from the first edge the second flat face will rotate towards the second surface.

3. The grooming device according to claim 1 wherein the second flat face lays flat against the second surface.

4. The grooming device according to claim 3
wherein the brush head is formed in the shape of a rectangular block;
wherein the each of the plurality of teeth project perpendicularly away from the first surface of the brush head.

* * * * *